US010920697B2

(12) United States Patent
Oshita et al.

(10) Patent No.: US 10,920,697 B2
(45) Date of Patent: Feb. 16, 2021

(54) FUEL-SAVING CONTROL DEVICE AND FUEL-SAVING CONTROL METHOD

(71) Applicant: ISUZU MOTORS LIMITED, Tokyo (JP)

(72) Inventors: Wasantha Oshita, Fujisawa (JP); Tomohiko Takeda, Machida (JP); Katsunori Kikuchi, Fujisawa (JP)

(73) Assignee: ISUZU MOTORS LIMITED, Tokyo (JP)

( * ) Notice: Subject to any disclaimer, the term of this patent is extended or adjusted under 35 U.S.C. 154(b) by 0 days.

(21) Appl. No.: 16/341,379

(22) PCT Filed: Oct. 11, 2017

(86) PCT No.: PCT/JP2017/036783

§ 371 (c)(1),
(2) Date: Apr. 11, 2019

(87) PCT Pub. No.: WO2018/070407

PCT Pub. Date: Apr. 19, 2018

(65) Prior Publication Data

US 2020/0056560 A1 Feb. 20, 2020

(30) Foreign Application Priority Data

Oct. 12, 2016 (JP) ..... 2016-200899

(51) Int. Cl.
*F02D 41/10* (2006.01)
*F02D 41/40* (2006.01)
*F02D 41/38* (2006.01)

(52) U.S. Cl.
CPC ..... *F02D 41/10* (2013.01); *F02D 41/40* (2013.01); *F02D 2041/389* (2013.01);
(Continued)

(58) Field of Classification Search
CPC ..... F02D 41/10; F02D 41/40; F02D 2250/18; F02D 2200/701; F02D 2200/602;
(Continued)

(56) References Cited

U.S. PATENT DOCUMENTS

2003/0173125 A1* 9/2003 Ishikawa ..... B60L 15/2009 180/65.26
2005/0029021 A1* 2/2005 Rigazzi ..... B60W 10/08 180/65.25
(Continued)

FOREIGN PATENT DOCUMENTS

DE 112012007222 T5 9/2015
JP 2004-168154 A 6/2004
(Continued)

OTHER PUBLICATIONS

International Search Report and Written Opinion for related International Application No. PCT/JP2017/036783, dated Jan. 16, 2018; English translation of ISR provided; 8 pages.
Extended European Search Report for related EP App No. 17860931.9 dated Sep. 11, 2019, 12 pgs.

*Primary Examiner* — Joseph J Dallo
(74) *Attorney, Agent, or Firm* — Procopio, Cory, Hargreaves & Savitch LLP

(57) ABSTRACT

A fuel-saving control device 100 equipped with: a surplus drive force calculation unit 101 for calculating surplus drive force; a fuel-saving control unit 102 for executing a fuel-saving control which lowers and corrects the indicated fuel injection amount according to the accelerator position by using a lowering-correction value that corresponds to the surplus drive force when the surplus drive force reaches or exceeds a prescribed threshold, and stopping the fuel-saving control when the surplus drive force falls below the prescribed threshold; a vehicle position detection unit 107 for detecting the vehicle position; a map information storage unit 108 for storing map information; and a forward curva-
(Continued)

ture radius identification unit 109 for identifying the forward curvature radius on the basis of the vehicle position and the map information. Therein, the fuel-saving control unit 102 prevents the lowering-correction value from varying by a prescribed degree of variability or more when the forward curvature radius is less than the prescribed threshold.

8 Claims, 3 Drawing Sheets

(52) U.S. Cl.
CPC ..... *F02D 2200/1002* (2013.01); *F02D 2200/602* (2013.01); *F02D 2200/701* (2013.01); *F02D 2250/18* (2013.01)

(58) Field of Classification Search
CPC ..... F02D 2200/1002; F02D 2041/389; F02D 41/04; F02D 29/02; F02D 2200/702; F02D 11/105; F02D 41/1497
See application file for complete search history.

(56) References Cited

U.S. PATENT DOCUMENTS

| | | | | |
|---|---|---|---|---|
| 2010/0191434 | A1* | 7/2010 | Fujita | B60W 30/188 701/91 |
| 2012/0209462 | A1* | 8/2012 | Roos | B60W 10/26 701/22 |
| 2013/0103238 | A1* | 4/2013 | Yu | B60W 20/12 701/22 |
| 2015/0315991 | A1* | 11/2015 | Miura | F02D 29/02 701/48 |
| 2016/0318514 | A1* | 11/2016 | Kuwahara | B60W 30/18136 |
| 2017/0298849 | A1* | 10/2017 | Be | F02N 11/0814 |
| 2019/0202438 | A1* | 7/2019 | Park | B60K 6/48 |

FOREIGN PATENT DOCUMENTS

| | | | |
|---|---|---|---|
| JP | 2008-115814 | A | 5/2008 |
| JP | 2012-002194 | A | 1/2012 |
| JP | 2012-076700 | A | 4/2012 |
| JP | 2013-216287 | A | 10/2013 |
| JP | 2016-061177 | A | 4/2016 |

* cited by examiner

FUEL-SAVING CONTROL DEVICE AND FUEL-SAVING CONTROL METHOD

TECHNICAL FIELD

The present disclosure relates to a fuel-saving control device and a fuel-saving control method.

BACKGROUND ART

A fuel-saving control is widely known, in which, while a vehicle is traveling with an instructed fuel injection amount depending on an accelerator position, the instructed fuel injection amount is intentionally lowered and corrected by using a lowering correction value depending on a surplus driving force when a surplus driving force becomes equal to or greater than a threshold value, thereby reducing an actual fuel consumption of an engine (e.g., see PTL 1). By executing the fuel-saving control, an accelerating force of the vehicle is limited. However, when the surplus driving force becomes smaller than the threshold value or a kickdown operation is detected, the fuel-saving control is stopped. As a result, a driver is hardly influenced by the limited accelerating force of the vehicle, and convenience of the driver is prevented from being greatly impaired due to execution of the fuel-saving control.

In addition to PTL 1, examples of the related art related to such a fuel-saving control device are also disclosed in PTL 2 and PTL 3.

CITATION LIST

Patent Literature

[PTL 1] JP-A-2016-061177
[PTL 2] JP-A-2004-168154
[PTL 3] JP-A-2012-076700

SUMMARY OF INVENTION

Technical Problem

As described above, the fuel-saving performance of the vehicle is maximally enhanced by using the lowering correction value depending on the surplus driving force when the fuel-saving control is executed. Specifically, the actual fuel consumption is reduced as much as possible by increasing the lowering correction value as the surplus driving force increases. However, for example, when the vehicle is travelling on a mountain road (meandering road), in which a plurality of uphill road sections are connected to one another by a flat curve or a flat road section, the surplus driving force is frequently changed and thus the lowering correction value is also frequently changed. As a result, an accelerating force of the vehicle is frequently changed, thereby making a vehicle behavior unstable. Accordingly, the convenience and safety of the driver may be impaired.

Accordingly, an object of the present disclosure is to provide a fuel-saving control device and a fuel-saving control method, in which even in a situation where a surplus driving force is frequently changed, it is possible to suppress a vehicle behavior from being frequently changed in accordance with execution of a fuel-saving control, thereby ensuring convenience and safety of a driver.

Solution to Problem

In a first aspect of the present disclosure, there is provided a fuel-saving control device, including: a surplus driving force calculation unit for calculating a surplus driving force; a fuel-saving control unit configured to execute a fuel-saving control for lowering and correcting an instructed fuel injection amount depending on an accelerator position using a lowering correction value depending on the surplus driving force when the surplus driving force becomes equal to or greater than a first threshold value, and configured to stop the fuel-saving control when the surplus driving force becomes smaller than the first threshold value, a vehicle position detection unit for detecting a vehicle position; a map information storage unit for storing map information; and a front curvature radius identification unit for identifying a front curvature radius based on the vehicle position and the map information, and, when the front curvature radius is smaller than a second threshold value, the fuel-saving control unit is configured not to change the lowering correction value at a change rate that is equal to or greater than a predetermined change rate.

When the front curvature radius is smaller than the second threshold value, the fuel-saving control unit may be further configured not to change the lowering correction value at the change rate that is equal to or greater than the predetermined change rate even if the surplus driving force crosses the first threshold value.

In a second aspect of the present disclosure, there is provided a fuel-saving control device, including: a surplus driving force calculation unit for calculating a surplus driving force; a fuel-saving control unit configured to execute a fuel-saving control for lowering and correcting an instructed fuel injection amount depending on an accelerator position by using a lowering correction value depending on the surplus driving force when the surplus driving force becomes equal to or greater than a first threshold value, and configured to stop the fuel-saving control when the surplus driving force becomes smaller than the first threshold value, a vehicle position detection unit for detecting a vehicle position; a map information storage unit for storing map information; and a front curvature radius identification unit for identifying a front curvature radius based on the vehicle position and the map information, and, when the front curvature radius is smaller than a second threshold value, the fuel-saving control unit is configured not to change the lowering correction value entirely.

When the front curvature radius is smaller than the second threshold value, the fuel-saving control unit may be further configured not to change the lowering correction value entirely even if the surplus driving force crosses the first threshold value.

In a third aspect of the present disclosure, there is provided a fuel-saving control method, including: a surplus driving force calculation step for calculating a surplus driving force; a fuel-saving control execution step for executing a fuel-saving control for lowering and correcting an instructed fuel injection amount depending on an accelerator position by using a lowering correction value depending on the surplus driving force when the surplus driving force becomes equal to or greater than a first threshold value; a fuel-saving control stop step for stopping the fuel-saving control when the surplus driving force becomes smaller than the first threshold value; a vehicle position detection step for detecting a vehicle position; and a front curvature radius identification step for identifying a front curvature radius based on the vehicle position and map information, and the fuel-saving control execution step and the fuel-saving control stop, when the front curvature radius is smaller than a second threshold value, the lowering correction value is not changed at a change rate that is equal to or greater than a predetermined change rate.

In the fuel-saving control execution step and the fuel-saving control stop step, when the front curvature radius is smaller than the second threshold value, the lowering correction value is not changed at the change rate that is equal to or greater than the predetermined change rate even if the surplus driving force crosses the first threshold value.

In a fourth aspect of the present disclosure, there is provided a fuel-saving control method, including: a surplus driving force calculation step for calculating a surplus driving force; a fuel-saving control execution step for executing a fuel-saving control for lowering and correcting an instructed fuel injection amount depending on an accelerator position by using a lowering correction value depending on the surplus driving force when the surplus driving force becomes equal to or greater than a first threshold value; a fuel-saving control stop step for stopping the fuel-saving control when the surplus driving force becomes smaller than the first threshold value, a vehicle position detection step for detecting a vehicle position; and a front curvature radius identification step for identifying a front curvature radius based on the vehicle position and map information, and in the fuel-saving control execution step and the fuel-saving control stop step, when the front curvature radius is smaller than a second threshold value, the lowering correction value is not changed entirely.

In the fuel-saving control execution step and the fuel-saving control stop step, when the front curvature radius is smaller than the second threshold value, the lowering correction value is not changed entirely even if the surplus driving force crosses the first threshold value.

Advantageous Effects of Invention

According to the present disclosure, the fuel-saving control device and the fuel-saving control method can be provided, in which even in a situation where a surplus driving force is frequently changed, it is possible to suppress a vehicle behavior from being frequently changed in accordance with execution of a fuel-saving control, thereby ensuring convenience and safety of a driver.

DESCRIPTION OF EMBODIMENTS

Hereinafter, embodiments of the present disclosure will be described with reference to the accompanying drawings.

First, a fuel-saving control device will be described.

The fuel-saving control device is mounted on an automobile traveling by transferring a driving force of an engine to a driving wheel of the vehicle via a transmission (a manual transmission vehicle or an automatic transmission vehicle).

Figure 1:
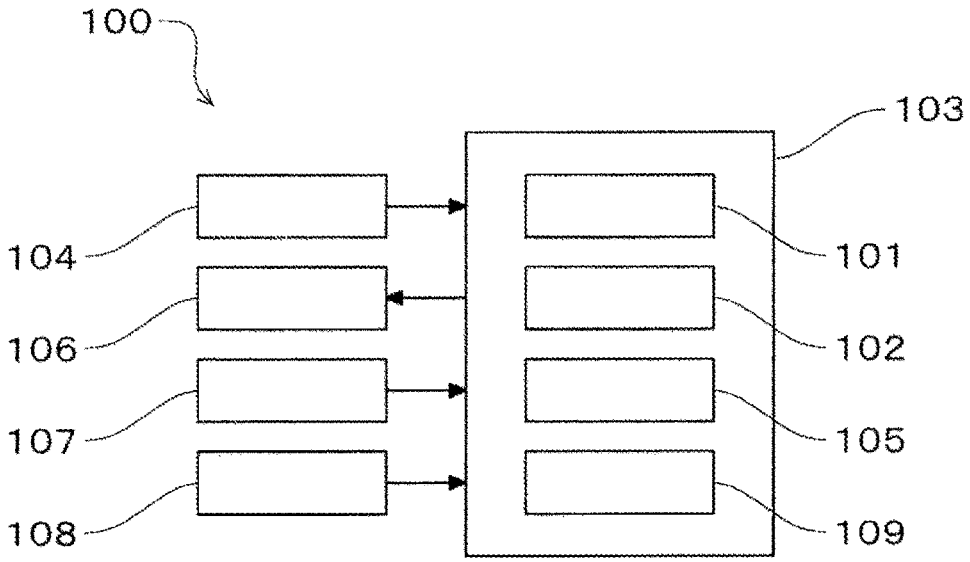
FIG. 1 is a configuration diagram of a fuel-saving control device according to an embodiment of the present disclosure.

As shown in FIG. 1, the fuel-saving control device 100 according to an embodiment of the present disclosure includes a surplus driving force calculation unit 101 for calculating a surplus driving force, and a fuel-saving control unit 102 for stopping a fuel-saving control when the surplus driving force becomes smaller than a first threshold value.

Typically, a vehicle travels with an instructed fuel injection amount depending on an accelerator position. However, when a surplus driving force becomes equal to or greater than a first threshold value, a fuel-saving control is executed for lowering and correcting the instructed fuel injection amount by using a lowering correction value depending on the surplus driving force.

The surplus driving force is defined by a difference between a driving force of a driving wheel and a traveling resistance on the vehicle. Also, stopping the fuel-saving control means that, by setting the lowering correction value to zero regardless of the surplus driving force, lowering and correcting the instructed fuel injection amount depending on the accelerator position is stopped and thus the control returns to a normal control.

The surplus driving force calculation unit 101 is configured to calculate a surplus driving force by calculating a difference between the driving force of the driving wheel and a travelling resistance force on the vehicle. The fuel-saving control unit 102 is configured to reduce an actual fuel consumption of the engine and thus to limit an accelerating force of the vehicle by intentionally lowering and correcting an instructed fuel injection amount, which originally depends on the accelerator position by a driver, by using the lowering correction value depending on the surplus driving force, when the surplus driving force becomes equal to or greater than the first threshold value. Herein, limiting the accelerating force of the vehicle (a force required for accelerating the vehicle) means limiting a torque of the engine, a power of the engine and/or an acceleration of the vehicle (a rate of change in speed thereof from before the vehicle is accelerated). Also, the fuel-saving control unit 102 may be further configured to stop the fuel-saving control even if the surplus driving force does not become smaller than the first threshold value, when a kickdown operation of the driver is detected. The reason is that a fuel-saving performance of the vehicle needs not to be prioritized even when the driver desires to increase an accelerating force of the vehicle and thus pushes a kickdown switch or steps an accelerator pedal, but convenience and safety of the driver should be ensured. A controller 103 gets all variables for controlling the engine with various instruments. For example, the controller 103 gets an accelerator position with an accelerator position sensor 104. Also, the controller 103 is equipped with an instructed fuel injection amount calculation unit 105 for calculating an instructed fuel injection amount depending on the accelerator position, and is configured to control a fuel injector 106 for injecting fuel into a cylinder of the engine. The fuel injector 106 is configured to inject fuel into the cylinder of the engine in accordance with the instructed fuel injection amount depending on the accelerator position.

As described above, the fuel-saving performance of the vehicle is maximally enhanced by using the lowering correction value depending on the surplus driving force when the fuel-saving control is executed. Specifically, the actual fuel consumption is reduced as much as possible by increasing the lowering correction value as the surplus driving force increases. However, for example, when the vehicle is travelling on a mountain road (meandering road), in which a plurality of uphill road sections are connected to one another by a flat curves or a flat road section, the surplus driving force is frequently changed and thus the lowering correction value is also frequently changed. As a result, an accelerating force of the vehicle is frequently changed, thereby making a vehicle behavior unstable. Accordingly, the convenience and safety of the driver may be impaired.

Therefore, the fuel-saving control device 100 further includes a vehicle position detection unit 107 for detecting a vehicle position, a map information storage unit 108 for storing map information, and a front curvature radius identification unit 109 for identifying a front curvature radius based on the vehicle position and the map information. Herein, the front curvature radius means a curvature radius between two points on a road on which the vehicle is expected to travel in the near future. The vehicle position detection unit 107 is constituted, for example, by a global positioning system receiver. The map information storage unit 108 is constituted, for example, by a storage medium separate from the controller 103.

In the fuel-saving control device 100, the fuel-saving control unit 102 is configured not to change the lowering correction value at a change rate that is equal to or greater than a predetermined change rate, namely, to limit the lowering correction value at a change rate that is smaller than the predetermined change rate, when the front curvature radius is smaller than a second threshold value. When the front curvature radius is smaller than the second threshold value, it is expected that the surplus driving force is frequently changed. Accordingly, by not changing the lowering correction value at the change rate that is equal to or greater than the predetermined change rate, it is possible to suppress the vehicle behavior from being frequently changed in accordance with execution of the fuel-saving control, thereby ensuring the convenience and safety of the driver.

Also, when the front curvature radius is smaller than the second threshold value, the fuel-saving control unit 102 may be configured to change the lowering correction value at the change rate that is equal to or greater than the predetermined change rate even if the surplus driving force crosses the first threshold value. Herein, the state where the surplus driving force crosses the first threshold value means that a state where the surplus driving force is greater than the first threshold value and a state where the surplus driving force is smaller than the first threshold value repeatedly occur within a predetermined period of time. When the surplus driving force becomes smaller than the first threshold value while the fuel-saving control is being executed, the fuel-saving control is stopped. However, by stopping the fuel-saving control, the lowering correction value has no value (e.g., the lowering correction value becomes 0 in a case where the lowering correction value is an addition value, and the lowering correction value becomes 1 in a case where the lowering correction value is a multiplication value). As a result, when the fuel-saving control is switched from execution to stop, there is a risk that the lowering correction value is largely changed. Also, when the surplus driving force becomes equal to or greater the first threshold value while the fuel-saving control is stopped, the fuel-saving control is executed. However, by executing the fuel-saving control, the lowering correction value has a certain value. As a result, when the fuel-saving control is switched from stop to execution, there is a risk that the lowering correction value is largely changed. When the lowering correction value is largely changed, an accelerating force of the vehicle is also largely changed, thereby making the vehicle behavior unstable. Meanwhile, the predetermined change rate may be a fixed value or a variable value. As a method for not changing the lowering correction value at the change rate that is equal to or greater than the predetermined change rate, for example, a method of limiting a change in the lowering correction value to a narrow range by using an averaging filter can be conceived. By properly adjusting a filter coefficient of the averaging filter, it is possible to minimize a change in the accelerating force of the vehicle.

Also, although the fuel-saving control unit 102 is configured to change the lowering correction value at the change rate that is equal to or greater than the predetermined change rate when the front curvature radius is smaller than the second threshold value, the fuel-saving control unit 102 may be configured not to change the lowering correction value entirely, namely, to fix the lowering correction value, when the front curvature radius is smaller than a second threshold value. In the case of not changing the lowering correction value entirely, the fuel-saving performance of the vehicle may be slightly decreased, as compared with the case of not changing the lowering correction value at the change rate that is equal to or greater than the predetermined change rate. However, when the front curvature radius is smaller than the second threshold value, the accelerating force of the vehicle is not changed at all. Therefore, in a situation where there is a risk of causing the driver to be in danger, the maximum safety can be provided to the driver. Thus, the control of not changing the lowering correction value at the change rate that is equal to or greater than the predetermined change rate and the control of not changing the lowering correction value entirely can be appropriately selected depending on situations, thereby ensuring the convenience and safety of the driver while enhancing the fuel-saving performance of the vehicle.

Next, a fuel-saving control method will be described.

Figure 2:
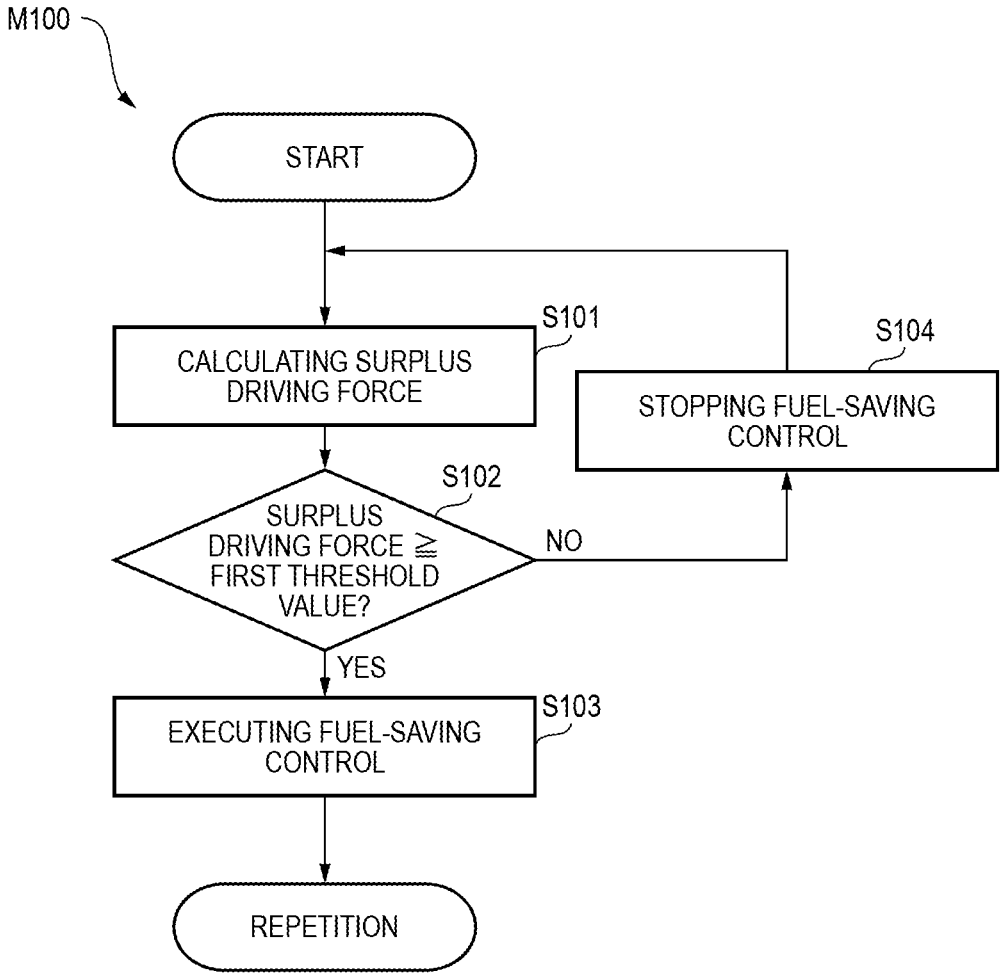
FIG. 2 is a flow chart of a basic fuel-saving control method of a fuel-saving control method according to an embodiment of the present disclosure.

As shown in FIG. 2, a fuel-saving control method according to an embodiment of the present disclosure includes a basic fuel-saving control method M100 to be executed by the fuel-saving control device 100 after an ignition key is turned on. The basic fuel-saving control method M100 includes a surplus driving force calculation step S101, a surplus driving force determination step S102, a fuel-saving control execution step S103, and a fuel-saving control stop step S104.

In the surplus driving force calculation step S101, the surplus driving force calculation unit 101 calculates a surplus driving force. In the surplus driving force determination step S102, the fuel-saving control unit 102 determines whether the surplus driving force is equal to or greater than the first threshold value. When the surplus driving force is equal to or greater than the first threshold value, the method proceeds to the fuel-saving control execution step S103, whereas when the surplus driving force is smaller than the first threshold value, the method proceeds to the fuel-saving control stop step S104. In the fuel-saving control execution step S103, the fuel-saving control unit 102 executes a fuel-saving control for lowering and correcting an instructed fuel injection amount depending on an accelerator position by using a lowering correction value depending on the surplus driving force. In the fuel-saving control stop step S104, the fuel-saving control unit 102 stops the fuel-saving control.

Figure 3:
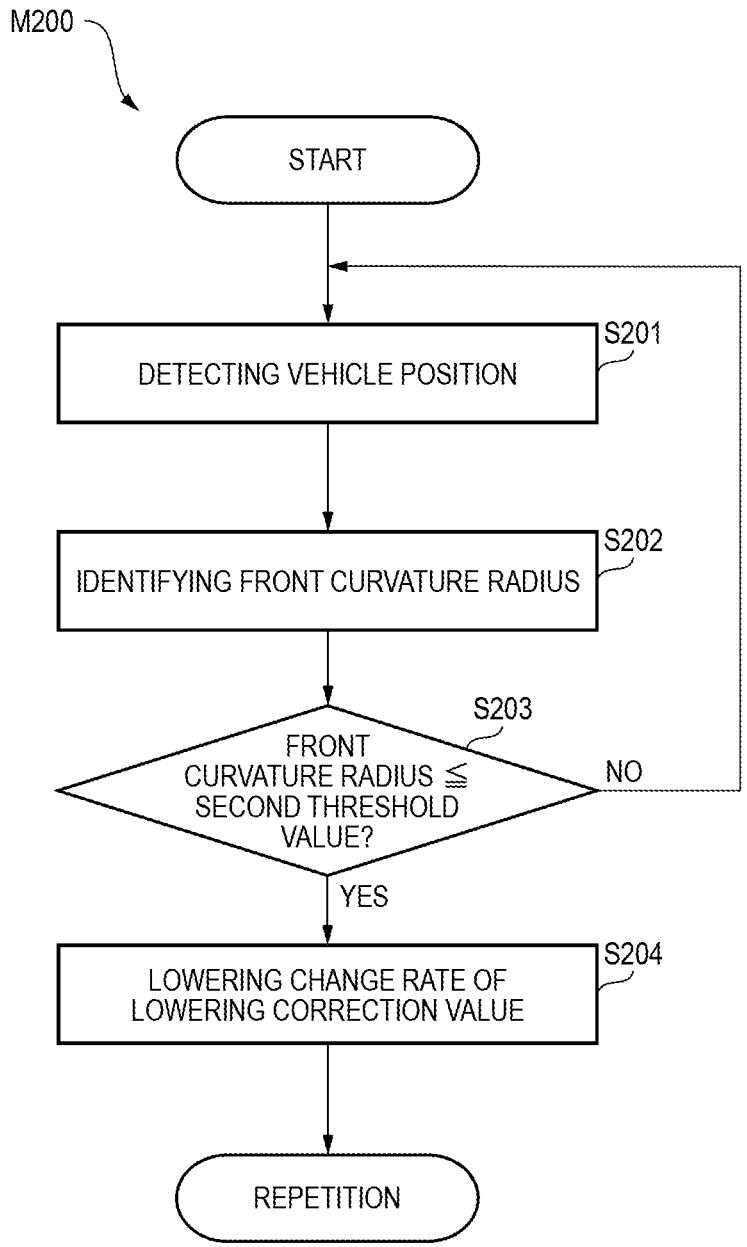
FIG. 3 is a flow chart of an extended fuel-saving control method of a fuel-saving control method according to an embodiment of the present disclosure.

Further, as shown in FIG. 3, the fuel-saving control method according to the embodiment of the present disclosure includes an extended fuel-saving control method M200 to be executed by the fuel-saving control device 100 after the ignition key is turned on. The extended fuel-saving control method M200 includes a vehicle position detection step S201, a front curvature radius identification step S202, a front curvature radius determination step S203, and a change-in-lowering-correction-value limit step S204.

In the vehicle position detection step S201, the vehicle position detection unit 107 detects a vehicle position. In the front curvature radius identification step S202, the front curvature radius identification unit 109 identifies a front curvature radius based on the vehicle position and the map information. In the front curvature radius determination step S203, the fuel-saving control unit 102 determines whether the front curvature radius is smaller than a second threshold value. When the front curvature radius is smaller than the second threshold value, the method proceeds to the change-in-lowering-correction-value limit step S204, whereas when the front curvature radius is not smaller than the second threshold value, the method returns to the vehicle position detection step S201. In the change-in-lowering-correction-value limit step S204, the fuel-saving control unit 102 changes the lowering correction value at a low change rate. Therefore, in the fuel-saving control execution step S103 described above, it is possible not to change the lowering correction value at a change rate that is equal to or greater than the predetermined change rate, when the front curvature radius is smaller than the second threshold value. Also, it is possible not to change the lowering correction value at the change rate that is equal to or greater than the predetermined change rate even if the surplus driving force crosses the first threshold value, when the front curvature radius is smaller than the second threshold value. For example, although numerical values is meaningless, in a situation where a state where the fuel-saving control is executed by using a lowering correction value of −10% is transited to a state where the fuel-saving control is stopped and thus the lowering correction value is 0%, the lowering correction value is not suddenly changed to 0%, but is changed to gradually approach 0%, such as −8%, −6% . . . . Also, on the contrary, in a situation where a state where the fuel-saving control is stopped and thus the lowering correction value is 0% is transited to a state where the fuel-saving control is executed by using a lowering correction value of −10%, the lowering correction value is not suddenly changed to −10%, but is changed to gradually approach −10%, such as −2%, −4% . . . . On the other hand, in a case where changing the lowering correction value at the low change rate is being executed via the previous control loop, as a case where the method returns to the vehicle position detection step S201 via the front curvature radius determination step S203, changing the lowering correction value at the low change late is canceled.

Further, instead of the change-in-lowering-correction-value limit step S204, a lowering correction value fixing step may be executed. In the lowering correction value fixing step, the fuel-saving control unit 102 fixes the lowering correction value. For example, in order to execute the lowering correction value fixing step, the previous lowering correction value is used as a fixed value. For example, although numerical values is meaningless, in a situation where a state where the fuel-saving control is executed by using a lowering correction value of −10% is transited to a state where the fuel-saving control is stopped and the lowering correction value is 0%, the lowering correction value is not changed to 0%, but kept at −10%. Therefore, in the fuel-saving control execution step S103 and the fuel-saving control execution step S104 described above, it is possible not to change the lowering correction value entirely, when the front curvature radius is smaller than the second threshold value. Also, it is possible not to change the lowering correction value entirely even if the surplus driving force crosses the first threshold value, when the front curvature radius is smaller than the second threshold value.

As described above, according to the present disclosure, in a case where the front curvature radius is smaller than the second threshold value and therefore the surplus driving force may be frequently changed, the lowering correction value is not changed at a change rate that is equal to or greater than the predetermined change rate, or the lowering correction value not is changed entirely. As a result, even in a situation where the surplus driving force is frequently changed, it is possible to suppress the vehicle behavior from being frequently changed in accordance with execution of the fuel-saving control, thereby ensuring the convenience and safety of the driver. In particular, in the case of the manual transmission vehicles, it is possible to push the driver to perform upshifting in advance by limiting an accelerating force of the vehicles. As a result, it is possible to greatly enhance the fuel-saving performance of the vehicle by executing the fuel-saving control.

This application is based on Japanese Patent Application No. 2016-200899 filed on Oct. 12, 2016, the entire contents of which are incorporated herein by reference.

INDUSTRIAL APPLICABILITY

The present disclosure has effects that even in a situation where the surplus driving force is frequently changed, it is possible to suppress the vehicle behavior from being frequently changed in accordance with execution of the fuel-saving control, thereby ensuring the convenience and safety of the driver and is useful for a fuel-saving control device and a fuel-saving control method and the like.

REFERENCE SIGNS LIST

100: Fuel-saving control device
101: Surplus driving force calculation unit
102: Fuel-saving control unit
103: Controller
104: Accelerator position sensor
105: Instructed fuel injection amount calculation unit
106: Fuel injector
107: Vehicle position detection unit
108: Map information storage unit
109: Front curvature radius identification unit
M100: Basic fuel-saving control method
S101: Surplus driving force calculation step
S102: Surplus driving force determination step
S103: Fuel-saving control execution step
S104: Fuel-saving control stop step
M200: Extended fuel-saving control method
S201: Vehicle position detection step
S202: Front curvature radius identification step
S203: Front curvature radius determination step
S204: Change-in-lowering-correction-value limit step

The invention claimed is:

1. A fuel-saving control device, comprising:

a surplus driving force calculation unit for calculating a surplus driving force which is defined by a difference between a driving force of a driving wheel and a travelling resistance on a vehicle; and a fuel-saving control unit configured to execute a fuel-saving control for lowering and correcting an instructed fuel injection amount depending on an accelerator position by using a lowering correction value depending on the surplus driving force when the surplus driving force becomes equal to or greater than a first threshold value, and configured to stop the fuel-saving control when the surplus driving force becomes smaller than the first threshold value, characterized by further comprising:

a vehicle position detection unit for detecting a vehicle position;

a map information storage unit for storing map information; and a front curvature radius identification unit for identifying a front curvature radius based on the vehicle position and the map information, wherein, when the front curvature radius is smaller than a second threshold value during execution of the fuel-saving control, the fuel-saving control unit is configured not to change the lowering correction value at a change rate that is equal to or greater than a predetermined change rate.

2. The fuel-saving control device according to claim 1, wherein, when the front curvature radius is smaller than the second threshold value, the fuel-saving control unit is configured not to change the lowering correction value at the change rate that is equal to or greater than the predetermined change rate even if the surplus driving force exceeds the first threshold value.

3. A fuel-saving control device, comprising:

a surplus driving force calculation unit for calculating a surplus driving force which is defined by a difference between a driving force of a driving wheel and a travelling resistance on a vehicle; and a fuel-saving control unit configured to execute a fuel-saving control for lowering and correcting an instructed fuel injection amount depending on an accelerator position by using a lowering correction value depending on the surplus driving force when the surplus driving force becomes equal to or greater than a first threshold value, and configured to stop the fuel-saving control when the surplus driving force becomes smaller than the first threshold value, characterized by further comprising:

a vehicle position detection unit for detecting a vehicle position;

a map information storage unit for storing map information; and a front curvature radius identification unit for identifying a front curvature radius based on the vehicle position and the map information, wherein, when the front curvature radius is smaller than a second threshold value dung execution of the fuel-saving control, the fuel-saving control unit is configured not to change the lowering correction value at all.

4. The fuel-saving control device according to claim 3, wherein, when the front curvature radius is smaller than the second threshold value, the fuel-saving control unit is configured not to change the lowering correction value at all even if the surplus driving force exceeds the first threshold value.

5. A fuel-saving control method, comprising:

a surplus driving force calculation step for calculating a surplus driving force which is defined by a difference between a driving force of a driving wheel and a travelling resistance on a vehicle;

a fuel-saving control execution step for executing a fuel-saving control for lowering and correcting an instructed fuel injection amount depending on an accelerator position by using a lowering correction value depending on the surplus driving force when the surplus driving force becomes equal to or greater than a first threshold value; and a fuel-saving control stop step for stopping the fuel-saving control when the surplus driving force becomes smaller than the first threshold value, characterized by further comprising:

a vehicle position detection step for detecting a vehicle position; and a front curvature radius identification step for identifying a front curvature radius based on the vehicle position and map information from a storage medium, wherein in the fuel-saving control execution step and the fuel-saving control stop step, when the front curvature radius is smaller than a second threshold value during execution of the fuel-saving control, the lowering correction value is not changed at a change rate that is equal to or greater than a predetermined change rate.

6. The fuel-saving control method according to claim 5, wherein in the fuel-saving control execution step and the fuel-saving control stop step, when the front curvature radius is smaller than the second threshold value, the lowering correction value is not changed at the change rate that is equal to or greater than the predetermined change rate even if the surplus driving force crosses the first threshold value.

7. A fuel-saving control method, comprising:

a surplus driving force calculation step for calculating a surplus driving force which is defined by a difference between a driving force of a driving wheel and a travelling resistance on a vehicle;

a fuel-saving control execution step for executing a fuel-saving control for lowering and correcting an instructed fuel injection amount depending on an accelerator position by using a lowering correction value depending on the surplus driving force when the surplus driving force becomes equal to or greater than a first threshold value; and a fuel-saving control stop step for stopping the fuel-saving control when the surplus driving force becomes smaller than the first threshold value, characterized by further comprising:

a vehicle position detection step for detecting a vehicle position; and a front curvature radius identification step for identifying a front curvature radius based on the vehicle position and map information from a storage medium, wherein in the fuel-saving control execution step and the fuel-saving control stop step, when the front curvature radius is smaller than a second threshold value during execution of the fuel-saving control, the lowering correction value is not changed at all.

8. The fuel-saving control method according to claim 7, wherein in the fuel-saving control execution step and the fuel-saving control stop step, when the front curvature radius is smaller than the second threshold value, the lowering correction value is not changed at all even if the surplus driving force exceeds the first threshold value.

* * * * *